US007451674B2

(12) United States Patent
Edgar

(10) Patent No.: US 7,451,674 B2
(45) Date of Patent: Nov. 18, 2008

(54) ADJUSTABLE CLICK-TYPE TORQUE WRENCH

(76) Inventor: Todd Edgar, 4711 Bradford NE., Grand Rapids, MI (US) 49525

( * ) Notice: Subject to any disclaimer, the term of this patent is extended or adjusted under 35 U.S.C. 154(b) by 0 days.

(21) Appl. No.: 11/566,801

(22) Filed: Dec. 5, 2006

(65) Prior Publication Data

US 2008/0060488 A1 Mar. 13, 2008

Related U.S. Application Data

(60) Provisional application No. 60/825,026, filed on Sep. 8, 2006.

(51) Int. Cl.
*B25B 23/159* (2006.01)

(52) U.S. Cl. ..... 81/483; 81/475; 73/862.21

(58) Field of Classification Search ..... 81/480–483, 81/478, 473–476; 73/862.23, 862.21
See application file for complete search history.

(56) References Cited

U.S. PATENT DOCUMENTS 2,962,918 A * 12/1960 Hoose ..... 81/481
3,772,942 A * 11/1973 Grabovac ..... 81/483
4,207,783 A * 6/1980 Grabovac ..... 81/483
4,467,678 A * 8/1984 Lindholm ..... 81/483
4,485,703 A * 12/1984 Grabovac et al. ..... 81/483
5,152,200 A * 10/1992 Kaplan ..... 81/478
5,497,682 A * 3/1996 Hsu ..... 81/483
5,503,042 A * 4/1996 Larson et al. ..... 81/478
5,662,012 A * 9/1997 Grabovac ..... 81/483

* cited by examiner

*Primary Examiner*—D. S Meislin
(74) *Attorney, Agent, or Firm*—Marshall, Gerstein & Borun LLP

(57) ABSTRACT

A torque wrench is disclosed that includes a drive head that defines a torque transfer axis and that is adapted to transfer torque to a workpiece. The torque wrench includes a tubular handle that is operative, upon rotation relative to a lever, to increase the bias on a spring upon lengthening a distance between the drive head and the opposite end of the handle, and to decrease the bias on the spring upon shortening the distance thereby setting the predetermined operating force.

13 Claims, 3 Drawing Sheets

ADJUSTABLE CLICK-TYPE TORQUE WRENCH

FIELD OF THE INVENTION

This invention relates to torque applying tools in general and more specifically to a user-adjustable click-type torque wrench.

BACKGROUND OF THE INVENTION

In many applications, the tightening of threaded fasteners to a specific degree or torque is of extreme importance. For example, in the assembly and maintenance of aircraft, every bolt, screw, and nut has a prescribed torque value and limit set by the American Society of Mechanical Engineers that is required for the aircraft to operate properly. Undertightening results in the fastener not working properly while overtightening may strip the threads of the fastener, break the fastener off in a threaded hole, or create vibrational problems in the resulting assembly.

Traditionally, torque wrenches have been used for tightening these devices. In addition to tightening the fastener, a torque wrench provides the user with an indication of the exact torque being applied. Some torque wrenches include indicators that provide a visual indication of the torque being applied so that the operator does not apply a greater torque than intended. A straight forward example is the bendable beam-type wrench with a strain gauge marked with numbered graduations. In this example, torque is indicated by the degree of deflection of the bendable beam relative to the strain gauge. Visually indicating torque wrenches are not useful in applications where visual observation of the torque indicator is obstructed or otherwise made difficult.

To overcome this problem, torque wrenches that provide a non-visual indication when a predetermined torque has been reached, such as an audible "click" or a movement providing "feel" to the operator, have been developed. These wrenches utilize spring tension to determine the amount of torque applied to tighten a threaded fastener and employ a mechanism that uses some type of metallic member that is released when the desired torque is obtained, thus striking the housing or other part of the wrench to produce an audible clicking sound.

The most popular type of this wrench is called a micrometer torque wrench and has a hollow arm which includes a spring and pawl mechanism for setting the torque. Within the hollow arm, the pawl is forced against one end of a bar that is connected to a drive head, the bar and a drive head are pinned to the hollow arm and rotate as torque is applied. The pawl is released when the force applied by the bar increases beyond a set value established by the operator. When released, the bar hits the inside of the arm, producing a sound and a distinct feel by a user. The torque value or release point is changed by rotating the handle, which moves on threads for setting. Additionally, values are permanently stamped or imprinted on a scale that is located on an outer surface of the hollow arm. Micrometer wrenches can overtorque when the operator continues to apply pressure after release, due to the momentum created by the releasing mechanism. This overtorque may occur without the user even realizing it. To solve this problem, "cam-over" wrenches replace the pawl with a ball bearing or roller held within a detent. A spring holds the ball within the detent and when the torque on the drive overcomes the spring force on the ball, the ball displaces and the ratchet rotates.

Adjustable torque wrenches have handles that can be turned to vary the compression of a spring, which, when properly calibrated, corresponds to a certain torque value.

Traditionally, a user has to turn the handle inward to compress the spring and set the wrench for higher torque values. At higher torque settings, this tool requires users to strain to turn the handle as it compresses against the main body of the tool. Also, this inward turning shortens the length of the tool. Again, more user-applied force is required to use a shorter tool when a higher torsional force is needed. The increased demand on the user decreases the amount of control the user has on the tool, which may result in injury to the user. The decreased control also exacerbates the common problem of the tool head slipping off of the work-piece, which can result in damage to the work-piece, the tool, or the operator.

On Aug. 28, 1984, U.S. utility Pat. No. 4,467,678 (filed Aug. 27, 1982) was granted to Lindholm. The title of the publication is "Torque Wrench." The content of this publication is incorporated by reference into this patent application as if fully set forth herein.

On Dec. 4, 1984, U.S. utility Pat. No. 4,485,703 (filed May 20, 1983) was granted to Grabovac. The title of the publication is "Torque Wrench." The content of this publication is incorporated by reference into this patent application as if fully set forth herein.

On Jul. 17, 1980, U.S. utility Pat. No. 4,207,783 (filed Apr. 14, 1978) was (granted to Grabovac. The title of the publication is "Torque Wrench." The content of this publication is incorporated by reference into this patent application as if fully set forth herein.

On Nov. 20, 1973, U.S. utility Pat. No. 3,772,942 (filed Jul. 27, 1972) was granted to Grabovac. The title of the publication is "Adjustable Torque Wrench." The content of this publication is incorporated by reference into this patent application as if fully set forth herein.

SUMMARY OF THE INVENTION

One of the primary objectives of the present invention is to provide an adjustable click-type torque wrench having an improved adjusting means for the spring that requires less user force to set the spring and use the tool.

BRIEF DESCRIPTION OF THE DRAWINGS

Various examples, objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF A BEST MODE EMBODIMENT

The present invention overcomes problems with the prior art by providing an adjustable torque wrench in which the maximum torque limit can be increased by rotating the tool in a manner to lengthen the tool.

Figure 1:
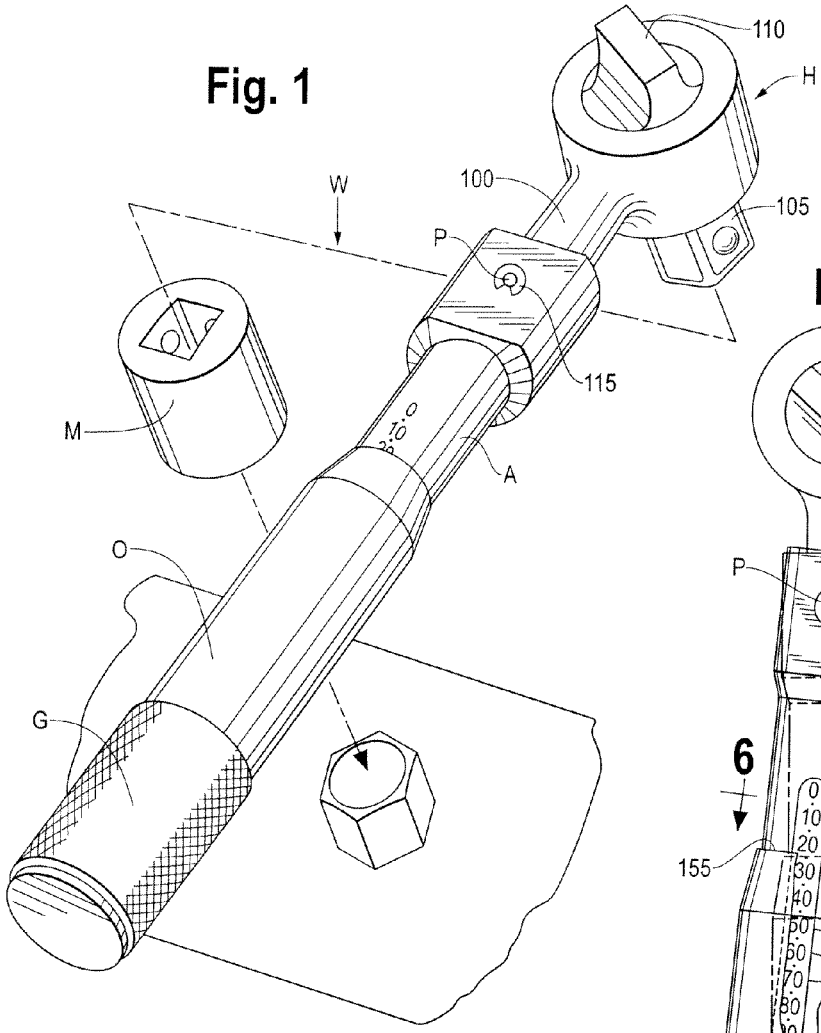
FIG. 1 is a plain view of one embodiment of the present invention.
Figure 2:
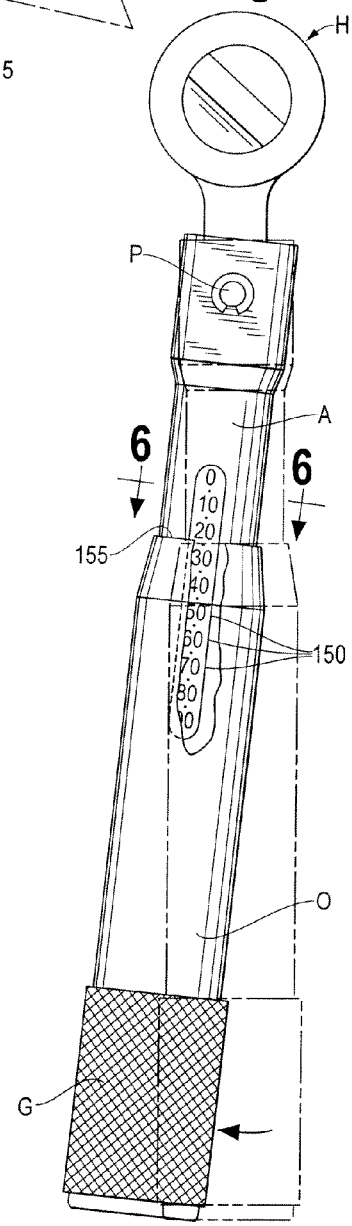
FIG. 2 is a partial cutaway longitudinal top view of the torque wrench in FIG. 1; the dotted outline illustrates the wrench in torque-exceeded mode.
Figure 3:
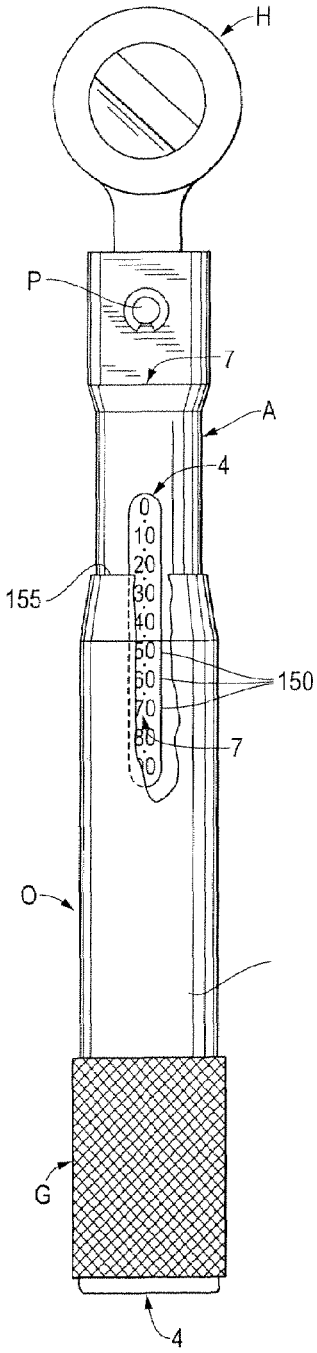
FIG. 3 is a partially broken away front vertical view of the torque wrench in FIG. 1 showing some internal components of the invention.

Referring now to the drawings, in particular to FIGS. 1-3, a torque wrench constructed in accordance with the present invention is indicated generally at W. The torque wrench W can be of the type having torque applying means in the form of a drive head or ratchet head, indicated generally at H, which can be formed integral with or otherwise suitably secured to one end of an elongated shank 100. The drive head H can be of any desired form and style and is shown in the illustrated embodiment as a reversible ratchet head with a square cross section work extension 105 for releasable engagement with conventional work pieces, such as socket members M. The drive head H can have a conventional ratchet mechanism (not shown) internally thereof operative through a thumb control 110 to enable reversal of the torque application direction.

The shank 100 is of predetermined length and can lie in a plane substantially normal to the torque axis defined by the lateral drive extension 105. In the illustrated embodiment, the shank 100 is substantially cylindrical and can receive a generally tubular lever A coaxially thereover. The lever A can be pivotally connected to the shank 100 generally adjacent the drive head H through a headed pivot pin P received through suitable aligned bores in the shank and lever and can be retained therein by a retainer ring 115 which can facilitate relative pivotal movement between the lever and the shank (as shown in outline in FIG. 2). The remaining length of lever A can be generally cylindrical and can have an internal surface 120 of predetermined diameter relative to the shank 100 so as to provide predetermined limited pivotal movement of lever A relative to the shank in either pivotal direction, considered in a plane transverse to the pivot axis P.

In accordance with the present invention and shown in FIG. 4, the lever A can be releasably interconnected to the shank 100 through coupling means, indicated generally at C, which can maintain the shank and lever in substantially fixed axially aligned relation to each other when a force below a predetermined force is applied to the lever during a torquing operation, but which effects relative movement between the shank and lever when the force applied to the lever establishes a torque greater than a predetermined torque. As will become more apparent herein below, when a predetermined torque is applied, the coupling means C can release the lever A from its generally axially aligned relation with the shank 100 such that the lever can undergo pivotal movement about the pivot axis P relative to the shank and can cause the free end 101 of the shank to strike the inner surface 120 of the lever and can provide an audible "click" and corresponding sensory feel to the operator to signal that the predetermined torque has been reached.

Referring particularly to FIGS. 4-7 the coupling means C can be any desired form and style and is shown in this embodiment as a "cam-over" couple. The coupling means C can include a spherical coupling member 125 that seats within a semispherical recess 127 formed within the free end 101 of shank 100. The recess 127 can have a radius of curvature substantially equal to the radius of the spherical coupling member 125 and can have a depth substantially equal to its radius so that the recess 127 can receive approximately one-half of the spherical coupling member therein.

The spherical coupling member 125 can be urged into the recess 127 by a generally cylindrical cup 130 having an outer diameter slightly smaller than the diameter of the inner surface 121 of lever A so as to facilitate a longitudinal sliding movement of the cup relative to the lever. The cup 130 can have an end surface 131 transverse to its longitudinal axis and in which can be a spherical recess 132 having a radius substantially equal to the radius of the spherical coupling member 125 and having a depth substantially smaller than the diameter of the coupling member 125.

The cup 130 can be urged against the coupling member 125 so as to maintain the coupling member within the recesses 127 and 132 by resilient means in the form of a coil compression spring means S. The means S is shown as an elongate helical compression spring in the lever A seated on the hexagonal shaft 142 of the compression means 140 that can project rearward from the cup 130 between the rear end of the cup 135 and the base end 145. As will become more apparent herein below, rotation of the adjustable handle portion O relative to the tubular lever A can vary the compression of spring S so as to selectively vary the force applied by the cup 130 against the coupling member 125 seated within recess 127 in shank 100.

The torque limit setting can be established by predetermined selection of the compression spring S and the rotational adjustment of handle portion O on the threaded end 122 of base B. Referring to FIGS. 3 and 6-9, handle O can be engaged with the invention and includes a spring compressing means, rearward of and engaging the rear end 135 of the cup 130, which can consist of a hexagonal shaft 142 extending axially rearward from cup 130 into lever A and handle O. The base end 145 can be engaged on the hexagonal shaft 142 as to contact handle O with cup 130. The cup 130 can have a plurality (8) of keys 134 on its top surface 131 to lock into a plurality (8) of slots 126 in the internal surface 120 of the lever A as to prevent independent rotation of the cup and the lever. Rotation of the external knurled surface G of the handle O in a mainer that can elongate the tool, counter-clockwise in the illustrated embodiment, can drive the base end 145 forwardly on the hexagonal shaft 142 which can compress the spring S towards the cup 130. To provide a visual indication of the selected torque limit at which the lever A will release from shank 100, torque value indicating markings 150 can be formed on the external surface of lever A in position for registration with an end surface 155 on the adjustable handle portion O. In this manner, the operator can adjust the torque wrench for a desired torque at which the audible indication is given after proper calibration of the tool. In a preferred embodiment, the spring compression means can be displaced from handle O to allow for calibration or replacement of the spring.

Figure 4:
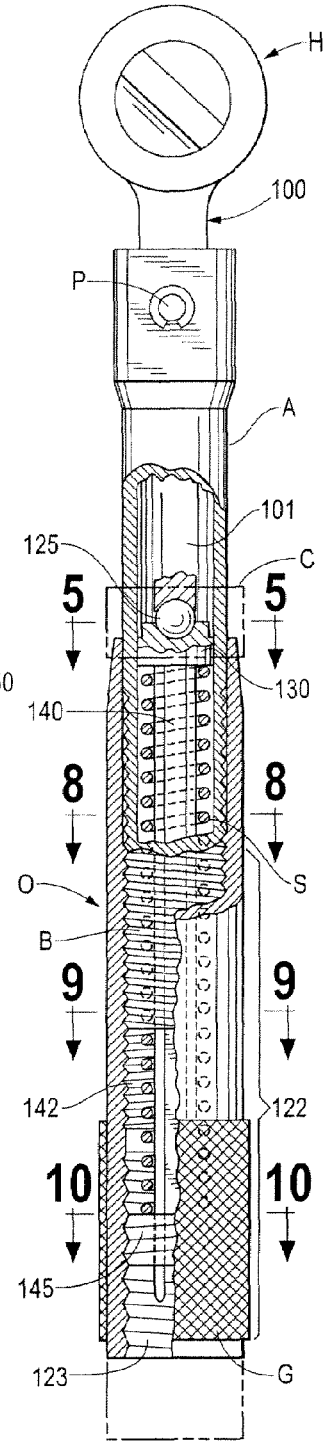
FIG. 4 is a partial vertical sectional view, showing various internal components of the invention, taken as indicated by line 4-4 on FIG. 3.
Figure 5:
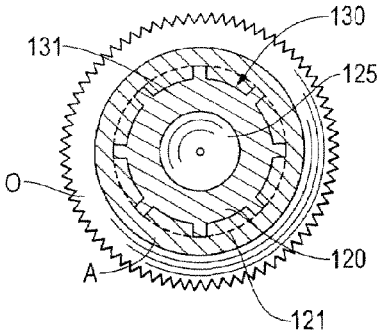
FIG. 5 is a cross-sectional view taken as indicated by line 5-5 on FIG. 3.
Figure 6:
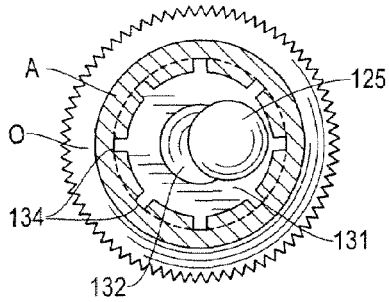
FIG. 6 is a cross-sectional view of a preferred coupling means of the wrench in torque-exceeded mode as indicated by line 6-6 on FIG. 2.
Figure 7:
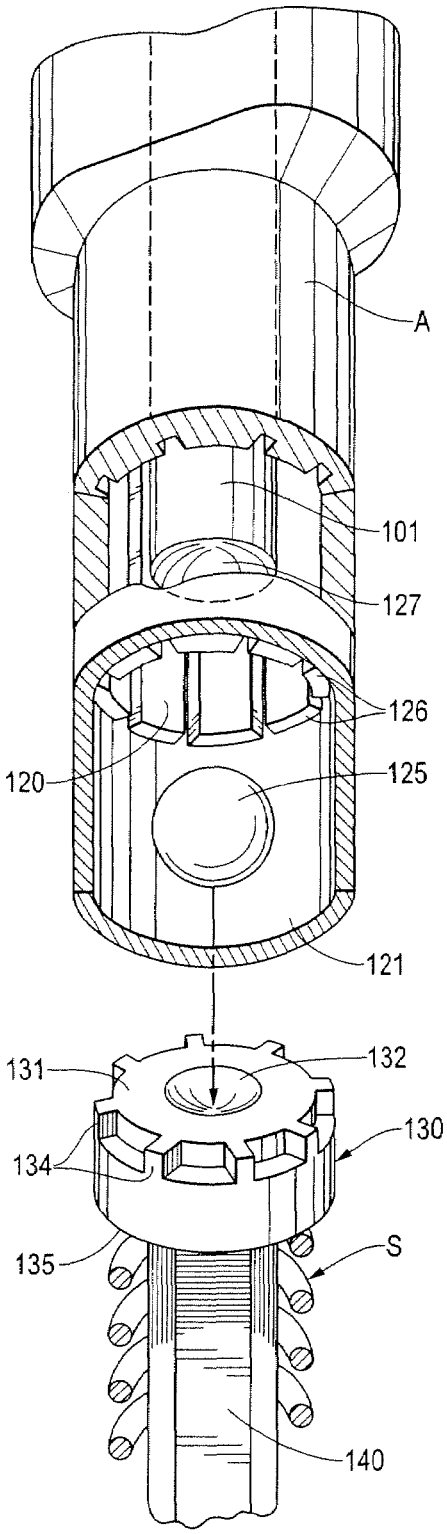
FIG. 7 is an enlarged detailed internal sectional view taken as indicated by line 7-7 on FIG. 3.
Figure 8:
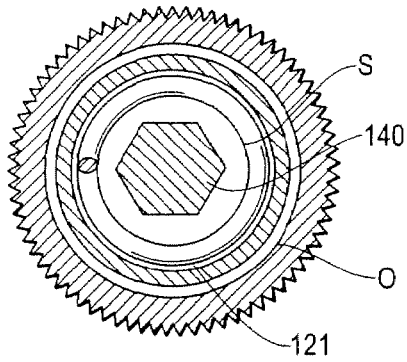
FIG. 8 is a cross-sectional view taken as indicated by line 8-8 on FIG. 4.
Figure 9:
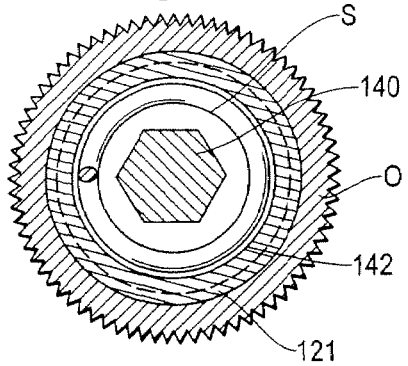
FIG. 9 is a cross-sectional view taken as indicated by line 9-9 on FIG. 4.
Figure 10:
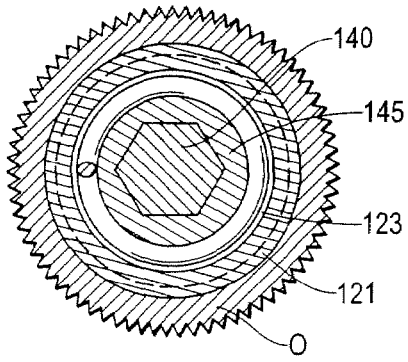
FIG. 10 is a cross-sectional view taken as indicated by line 10-10 on FIG. 4.

It will be appreciated that during operation of the torque wrench W in applying torque to a tool or work piece through the drive extension 105 in either rotational direction, the spherical coupling member 125 can remain seated within the mutually opposed recesses 127 and 132 until a predetermined torque is reached as shown in FIGS. 3 and 4. When the applied force on the lever is sufficient to further increase the torque, the coupling member 125 can move cup 130 longitudinally in a camming action against the compression spring S and thereby can release the lever A for pivotal movement relative to shank 100. The diameters of the shank free end 101 and the lever inner surface 120 can be selected such that the free end of the shank will engage the inner surface of the lever at substantially the moment when the coupling member 125 cams the cup 130 away from the free end of the shank and into the lever to effect an audible "click" providing both an audible and sensory feel indication to the operator that the predetermined torque has been reached. During such movement between the lever A and shank 100, the coupling member 125 can remain within the semispherical recess 127 as it rides up the recess surface 132 to force the cup 130 longitudinally away from the shank as shown in FIG. 6.

Thus, in accordance with the present invention, a torque wrench is provided which eases the burden on its user twice over by extending its length for applications requiring high torque and is adapted to establish an audible "click" and corresponding sensory feel when a predetermined torque has been applied to a tool or workpiece in either rotational direction.

While a preferred embodiment of the present invention has been illustrated and described, it will be understood to those skilled in the art that the changes and modifications may be made therein without departing from the invention and its broader aspects.

What is claimed:

1. A torque wrench comprising:

a drive head that defines a torque transfer axis and that is adapted to transfer torque to a workpiece;

a shank connected to the drive head so as to lie in a plane substantially normal to the torque transfer axis, the shank having a free end spaced away from the drive head;

a tubular lever disposed generally coaxially over the shank and connected thereto for pivotal movement relative to the shank about a pivot axis substantially transverse to the longitudinal axis of the shank;

a connection releasably interconnecting the shank to the lever so as to maintain the shank and the lever in substantially fixed relation to each other when force is applied to the lever in a direction to establish a torque less than a predetermined torque at the torque transfer axis, the connection being operative to enable relative movement between the shank and the lever when force applied to the lever effects a torque at the torque transfer axis greater than the predetermined torque;

an elongate axially biased compression spring with front and rear ends extending longitudinally in the lever rearward of the connection so as to allow the connection between the shank and the lever to be maintained;

a tubular handle mounted generally coaxially on the lever opposite its pivotal connection to the shank, the handle being rotatable about its longitudinal axis relative to the lever; and wherein the handle is operative upon rotation relative to the lever to increase the bias on the spring upon lengthening a distance between the head and the opposite end of the handle and decrease the bias on the spring upon shortening the distance thereby setting the predetermined operating force.

2. The torque wrench of claim 1, wherein the lever has external threads formed on its outer peripheral surface, the handle having internal threads formed therein cooperable with the external threads on the lever so as to effect relative longitudinal movement between the handle and the lever upon relative rotation therebetween.

3. The torque wrench of claim 2, wherein the connection comprises a cup longitudinally slidable within the lever and having an end surface opposed to the free end of the shank, the free end of the shank having a first semispherical recess of a predetermined diameter and depth formed therein, the end surface of the cup having a second generally semispherical recess of the predetermined diameter but of a depth less than the depth of the first recess.

4. The torque wrench of claim 3, further comprising a spherical coupling member mutually received within the first and second recesses and having a diameter substantially equal to the predetermined diameter.

5. The torque wrench of claim 4, wherein the spherical member is cooperative with the shank and the cup so as to maintain the shank and the lever in substantially fixed relation until a predetermined torque is established at the drive head whereupon the spherical member cams the cup away from the free end of the shank to enable pivotal movement of the lever relative to the shank and cause the shank to engage the inner surface of the lever to effect an audible indication that the predetermined torque has been reached.

6. The torque wrench of claim 1, wherein the connection comprises a cup longitudinally slidable within the lever and having an end surface opposed to the free end of the shank, the free end of the shank having a first semispherical recess of a predetermined diameter and depth formed therein.

7. The torque wrench of claim 6, wherein the end surface of the cup has a second generally semispherical recess of the predetermined diameter but of a depth less than the depth of the first recess.

8. The torque wrench of claim 7, further comprising a spherical coupling member mutually received within the first and second recesses and having a diameter substantially equal to the predetermined diameter.

9. The torque wrench of claim 8, wherein the spherical member is cooperative with the shank and the cup so as to maintain the shank and the lever in substantially fixed relation until a predetermined torque is established at the drive head whereupon the spherical member cams the cup away from the free end of the shank to enable pivotal movement of the lever relative to the shank and cause the shank to engage the inner surface of the lever to effect an audible indication that the predetermined torque has been reached.

10. The torque wrench of claim 2, wherein the spring extends longitudinally on a hexagonal shaft from the cup to a base end, the hexagonal shaft contacting and extending axially rearwardly from the cup into the lever and the handle, the base end being operative upon rotation of the handle relative to the lever to slide longitudinally on the hexagonal shaft.

11. The torque wrench of claim 2, wherein the cup is locked in a fixed relationship with the lever, the cup having a top surface, the top surface having a plurality of keys, the lever having an internal surface, the internal surface having a plurality of slots equal in number to the plurality of keys, the keys engaging the slots so as to prevent rotation of the cup relative to the lever upon rotation of the handle.

12. The torque wrench of claim 1, wherein the spring extends longitudinally on a hexagonal shaft from the cup to a base end, the hexagonal shaft contacting and extending axially rearwardly from the cup into the lever and the handle, the base end being operative upon rotation of the handle relative to the lever to slide longitudinally on the hexagonal shaft.

13. The torque wrench of claim 1, wherein the cup is locked in a fixed relationship with the lever, the cup having a top surface, the top surface having a plurality of keys, the lever having an internal surface, the internal surface having a plurality of slots equal in number to the plurality of keys, the keys engaging the slots so as to prevent rotation of the cup relative to the lever upon rotation of the handle.

* * * * *